US006695140B2

(12) United States Patent
Manuel

(10) Patent No.: US 6,695,140 B2
(45) Date of Patent: Feb. 24, 2004

(54) PACKAGING METHOD AND PROTECTIVE PACKAGING SYSTEM WITH AUTOMATIC POSITIONING COMPONENT

(75) Inventor: James Edwin Manuel, Austin, TX (US)

(73) Assignee: Dell Products, L.P., Round Rock, TX (US)

( * ) Notice: Subject to any disclaimer, the term of this patent is extended or adjusted under 35 U.S.C. 154(b) by 59 days.

(21) Appl. No.: 09/922,574

(22) Filed: Aug. 3, 2001

(65) Prior Publication Data

US 2003/0024836 A1 Feb. 6, 2003

(51) Int. Cl.[7] ..... B65D 85/00

(52) U.S. Cl. ..... 206/320; 206/477; 206/523; 206/576; 206/588

(58) Field of Search ..... 206/320, 477, 206/480, 482, 488, 486, 1.5, 521, 523, 588, 591, 592, 583, 576, 560, 565, 587; 53/390, 484, 377.6; 141/391; 284/544; 108/32; 414/276; 220/23.9

(56) References Cited

U.S. PATENT DOCUMENTS 4,527,690 A * 7/1985 Schmidts et al. ..... 206/477
5,074,800 A * 12/1991 Sasao et al. ..... 439/157
5,207,327 A 5/1993 Brondos ..... 206/523
5,211,568 A * 5/1993 Yamada et al. ..... 439/157
5,894,932 A 4/1999 Harding et al. ..... 206/583
5,943,218 A * 8/1999 Liu ..... 361/801
6,092,651 A 7/2000 Miller ..... 206/305
6,158,589 A 12/2000 Smith et al. ..... 206/466
6,230,916 B1 5/2001 Bradford et al. ..... 220/6

* cited by examiner

*Primary Examiner*—Mickey Yu
*Assistant Examiner*—John G Pickett
(74) *Attorney, Agent, or Firm*—Russell D. Culbertson; Shaffer & Culbertson, L.L.P.

(57) ABSTRACT

A pivot component (11) is inserted into a bottom component (12) positioned in a shipping container (43) and can be positioned in either a loading position or a support position. In the loading position, the pivot component (11) is tilted outwardly with respect to the bottom component (12), allowing a product (41) to be easily inserted in the container (43). When the product (41) is inserted into the container, contact between the product (41) and the pivot component (11) causes the pivot component (11) to automatically pivot into the support position. In the support position, the pivot component (11) is tilted inwardly with respect to the loading position, and is in position to support and protect the product (41) in the container (43). A top element (51) may be included over the product (41) in the received position so as to capture a top part of the pivot component (11) and thereby retain the pivot component in the support position.

14 Claims, 7 Drawing Sheets

PACKAGING METHOD AND PROTECTIVE PACKAGING SYSTEM WITH AUTOMATIC POSITIONING COMPONENT

TECHNICAL FIELD OF THE INVENTION

This invention relates to product shipping containers and protective packaging materials used in connection with shipping containers. More particularly, the invention relates to a packaging system that will support and protect a relatively heavy electronic system, such as a computer system, within a shipping container. The invention encompasses a protective packaging system that is used with a shipping container, and a shipping system that includes both the protective packaging system and its associated shipping container. The invention also encompasses a method for loading a computer system into a shipping container.

BACKGROUND OF THE INVENTION

Although modern electronic systems are relatively robust, it is still desirable to ship such systems in protective packaging. Protective packaging will protect the packaged system from cosmetic and perhaps more serious damage while in transit from the manufacturer to the consumer. Protective packaging is especially important for a relatively large and heavy system, such as a computer server system, which may include decorative covers and other exterior features that are vulnerable to damage during shipping. Traditional cushion material (e.g. polystyrene or polyethylene) spacers are many times inadequate for protecting heavier and more fragile systems. Also, some types of protective covers, such as plastic end caps, require additional packaging steps that increase packaging time.

Packaging for a computer system must be adapted to accommodate the weight of the system in a way that protects the equipment while increasing neither the cost of packaging, nor the time and number of steps required to package the system. Further, minimizing both the container size and the amount of protective packaging material is desirable for environmental reasons.

One solution to the problem of protecting heavy systems in transit to a customer is to increase the size and decrease the density of the protective foam used inside the shipping container, to soften the impact of a drop. The additional protective foam increases both the cost of the materials and the size of the package, making this solution undesirable.

SUMMARY OF THE INVENTION

An object of the invention is to provide a protective packaging system that supports and protects a product, such as a computer system, from damage during shipping and handling. Another object of the invention is to provide a protective packaging system that uses minimal material and does not increase the time required to package the product.

To accomplish these objects, the invention includes a packaging system having a bottom component and a pivot component. The bottom component is inserted into a shipping container in position to support a product, and preferably includes an opening in which the product can be snugly received. A pivot receptacle is formed in the bottom component that supports the pivot component in two alternative positions, a loading position and a support position. In the loading position, the pivot component is tilted outwardly with respect to the bottom component, which allows a product to be easily inserted into the container. As the product is inserted to a received position on the bottom component, contact between the product and the pivot component causes the pivot component to move automatically into the support position. In the support position, the pivot component is tilted inwardly with respect to the loading position so that it engages the product resting on the bottom component.

The pivot component preferably includes a rigid support structure and an inner protective element. The rigid support structure is made of a rigid material that allows the pivot component to firmly support the product in the received position. The inner protective element covers the inner side of the rigid support structure and is made of a resilient protective material that protects the product in the received position. Lateral support elements may be included at lateral edges of the pivot component. The lateral support elements, made up of relatively dense protective material, guide the pivot component into a proper support position and provide additional support when the product is in the received position.

The contact which moves the pivot component to the support position can occur on one or more projections that may extend from the inner side of the pivot component at a base edge thereof. In the preferred embodiment, the projections are located at the base of the lateral support elements.

Because it is important that the pivot component remain in the support position during shipment, a top component can be installed above the product in a position where it captures and retains the pivot component in the support position. This top component is preferably made of a resilient protective material that provides additional protection for the product.

The computer system packaging method according to the invention includes positioning the bottom component in a container and then positioning the pivot component in the loading position in the pivot receptacle of the bottom component. The method then includes inserting the computer system into the container. As the computer system is inserted, it contacts the pivot component, automatically moving the pivot component into the support position. The method may also include the step of retaining the pivot component in the support position with the top component installed over the product and the pivot component.

These and other objects, advantages, and features of the invention will be apparent from the following description of the preferred embodiment, when considered with the accompanying drawings.

DESCRIPTION OF THE PREFERRED EMBODIMENTS

Figure 1:
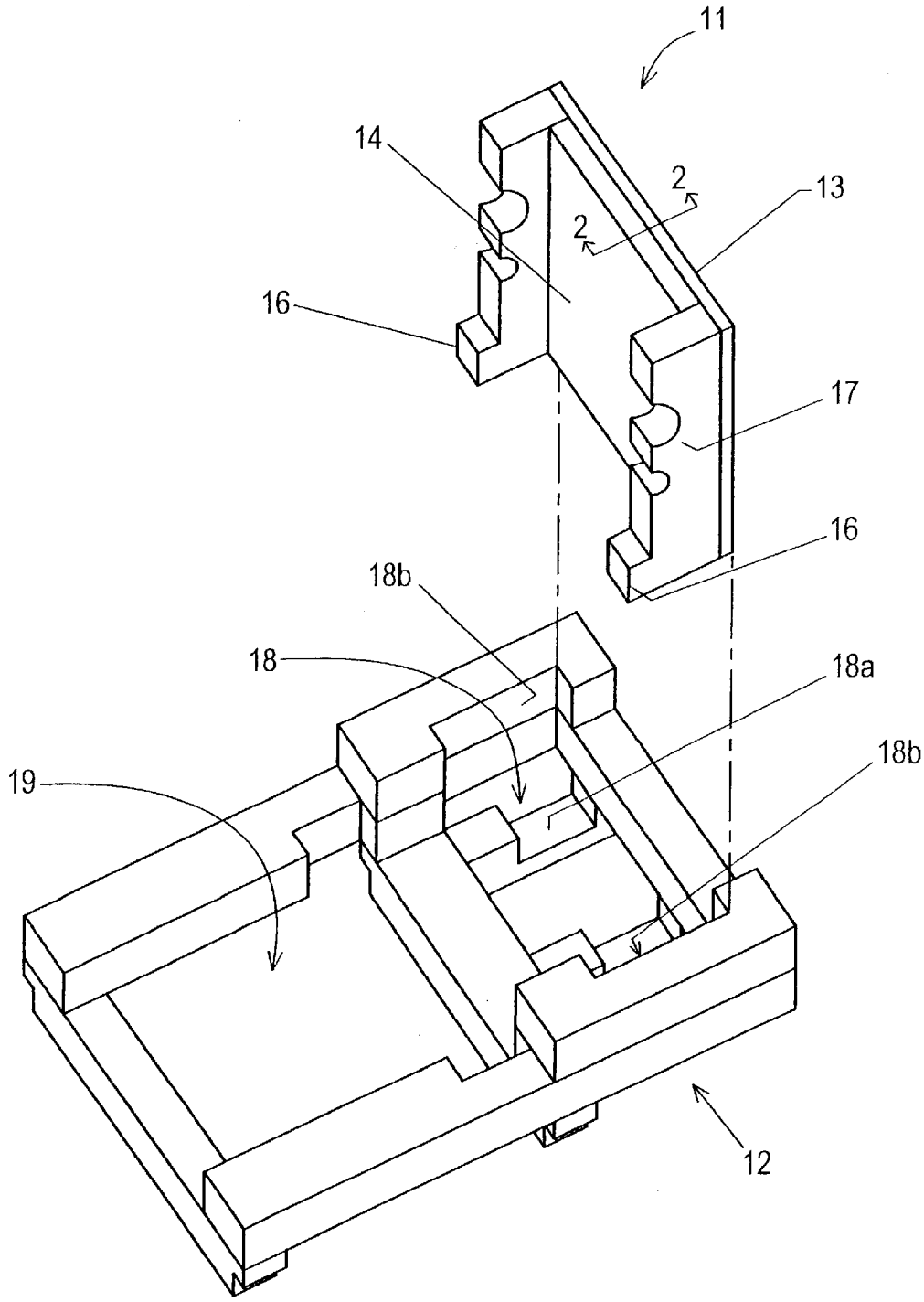
FIG. 1 is an exploded view in perspective of a pivot component and a portion of a bottom component embodying the principles of the invention.

FIG. 1 shows a pivot component 11 and a portion of a bottom component 12 embodying the principles of the invention. Bottom component 12 receives pivot component 11 in a pivot receptacle 18. When received in pivot receptacle 18, pivot component 11 can be placed either in a loading position or in a support position, each of which will be discussed with reference to FIGS. 4 and 5.

Figure 2:
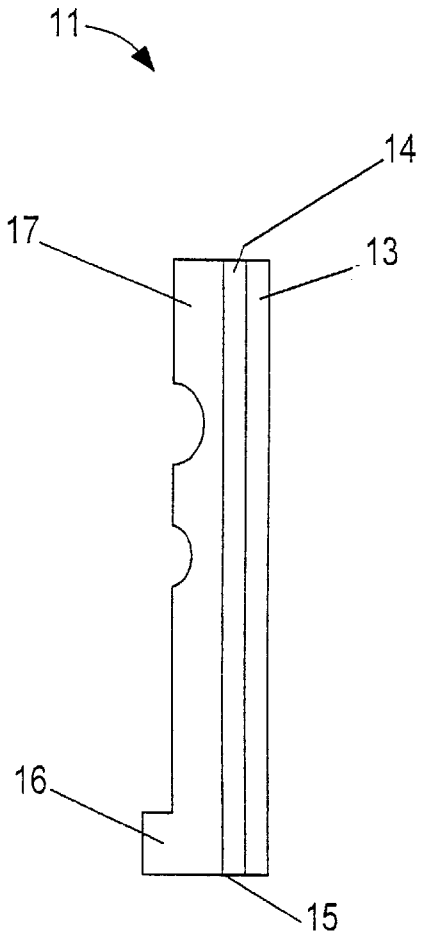
FIG. 2 is an enlarged view in section taken along line 2—2 in FIG. 1.

Pivot component 11 has a rigid support structure 13 and an inner protective element 14, shown in FIGS. 1 and 2. Rigid support structure 13 can be constructed of plywood, although one skilled in the art will appreciate that any suitable rigid material that provides a strong foundation for supporting the product can be used instead of plywood. Inner protective element 14 comprises a rubber or plastic foam or other suitable resilient protective material covering the inner side of rigid support structure 13 in position to protect the product to be shipped as will be described further below. It will be noted that pivot component 11 may alternatively be constructed of a suitable plastic or other material that serves as both rigid support structure 13 and inner protective element 14, thus accomplishing both the protecting and the supporting aspects of the invention.

FIGS. 1 and 2 also show lateral support elements 17 according to the invention. In the preferred embodiment, inner protective element 14 covers a center portion of the inner side of rigid support structure 13, and lateral support elements 17 are located along the length of the lateral edges of rigid support structure 13, on either side of inner protective element 14. Lateral support elements 17 extend from the rigid support structure farther than inner protective element 14 and are preferably constructed from a more dense rubber or plastic foam than inner protective element. The more dense lateral support elements 17 are particularly suited to support structural frame areas of the product being packaged. The superior strength of the product frame makes it advantageous to concentrate support in these areas. Lateral support elements 17 may also help guide the product into the container and help guide the pivot component 11 to the proper support position.

Pivot component 11 may include projections 16, as shown in the Figures. In the illustrated form of the invention, projections 16 are located on lateral support elements 17, although they could be located elsewhere on the inner side of rigid support structure 13. The function of projections 16 will be discussed later with reference to FIG. 4.

Figure 3:
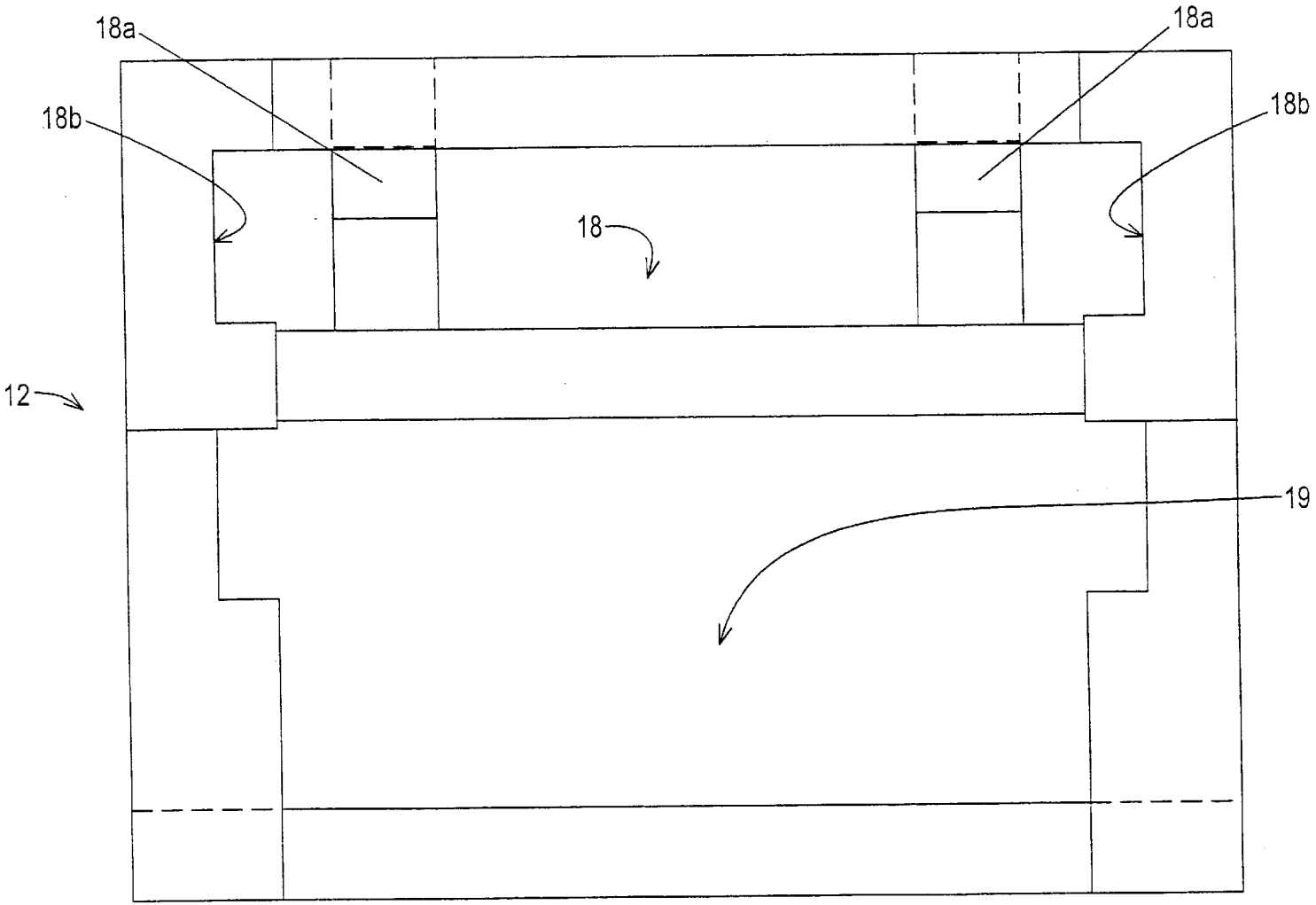
FIG. 3 is a top view of the portion of the bottom component shown in FIG. 1.

FIG. 3 shows a top view of one piece of bottom component 12. Bottom component 12 can consist of one, two, or several pieces that are positioned at the bottom of a container to form the entire bottom component 12. In the preferred form of the invention, two separate pieces act together to form bottom component 12, with each piece supporting an opposite end of the product to be shipped. It will be appreciated that each end of bottom component 12 can receive a different pivot component, each of which functions identically to the illustrated pivot component 11. Only one piece of bottom component 12 containing pivot receptacle 18 is shown in FIG. 3.

Figure 4:
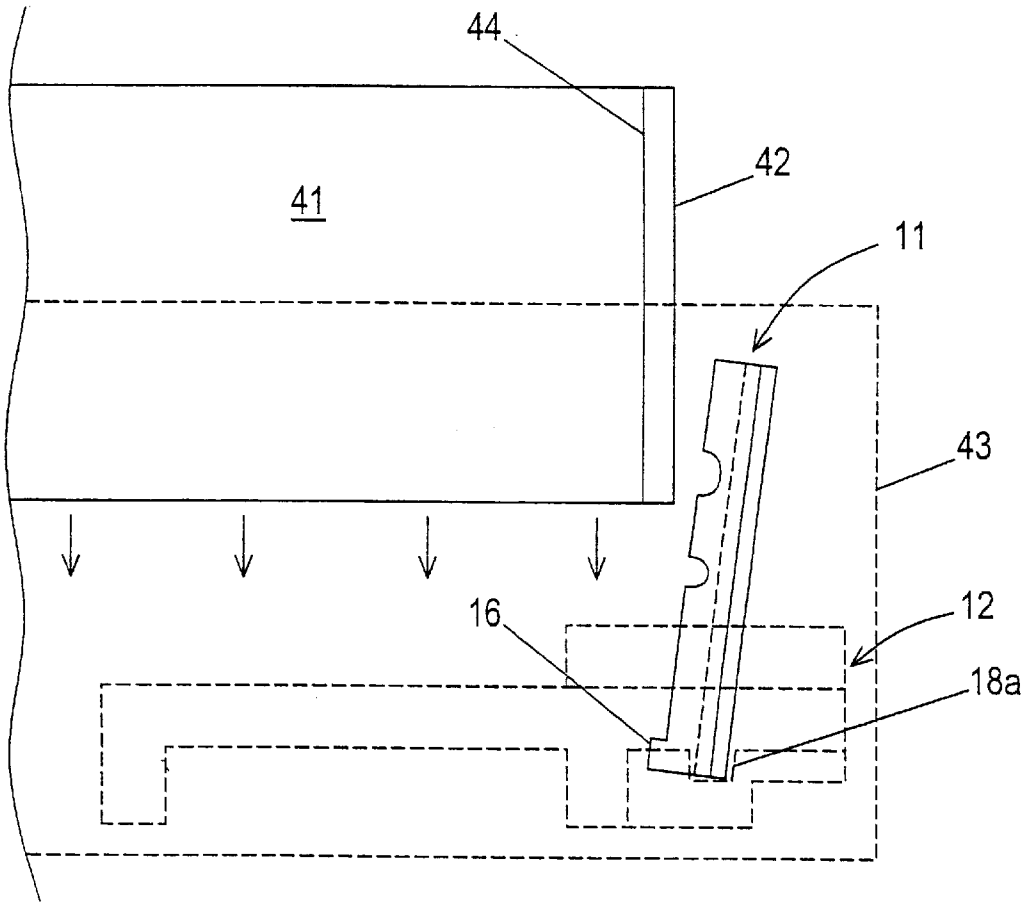
FIG. 4 is a side view of the packaging system inside a shipping container with both the shipping container and the bottom component shown in phantom lines.

The preferred bottom component 12 includes a product opening 19, shown best in FIGS. 3 and 4. Product opening 19 is desirable to protect the product with additional support along the lateral edges of the bottom of the product, but is not required by the invention.

In the illustrated form of the invention, pivot receptacle 18 comprises notches 18*a* and side slots 18*b* formed in bottom component 12. The base of pivot component 11 is supported in pivot receptacle notches 18*a*, formed in two members of bottom component 12. Side slots 18*b* serve as stops, limiting the range of motion of pivot component 11. One skilled in the art can appreciate that the pivot receptacle can vary in size, shape, and number of components. In each case, however, the pivot receptacle according to the invention supports pivot component 11 in both a loading position and a support position, and it allows movement of pivot component 11 between the loading and support positions.

Figure 5:
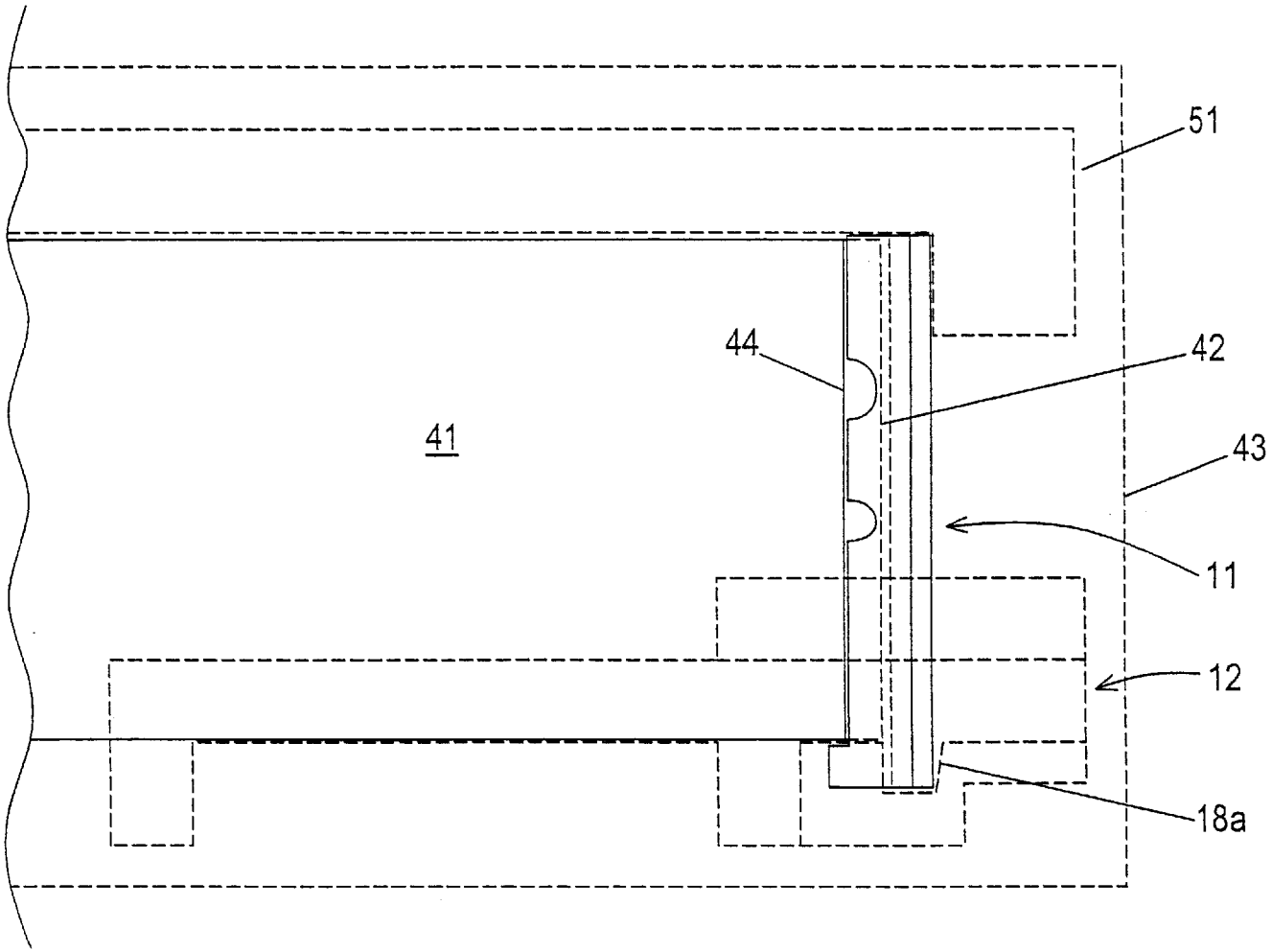
FIG. 5 is a side view similar to FIG. 4 but with a product in the received position, and with a top component shown in phantom lines as well.

FIGS. 4 and 5 show a container 43 in which the packaging system comprising bottom component 12 and pivot component 11 are positioned. Referring first to FIG. 4, bottom component 12 is positioned in the bottom of container 43 and pivot component 11 is received in pivot receptacle 18. According to the invention, pivot component 11 is in its loading position, tilted outwardly with respect to bottom component 12. The outwardly leaning pivot component 11 in the loading position effectively provides a larger opening for receiving the product 41. This makes positioning product 41 less critical as it is being inserted into container 43, and thus the product may be more easily inserted into the proper received position in the container. The illustrated container 43 has dimensions sufficiently large to allow pivot component 11 to tilt outwardly to the loading position defined by slots 18*b* (FIG. 3).

The movement of pivot component 11 from the loading position to the support position is caused by contact between the product 41 and the pivot component as the product is inserted into container 43. This contact can occur at one or more projections 16, located on the inner side of pivot component 11. The illustrated preferred embodiment includes two separate projections 16, one located on each lateral support element 17. As product 41 is inserted into the container, the product eventually contacts and applies a force to projections 16 in a direction perpendicular to the plane of bottom component 12. This force applied to projections 16 automatically moves pivot component 11 from the loading position to the support position. Although projections 16 may be helpful in moving pivot component 11 into the desired support position, they are not required if contact between the product 41 and the pivot component itself causes the desired movement from the loading to the support position.

In the form of the invention shown in FIGS. 4 and 5, the contact between product 41 and projections 16 occurs at a flange or edge 44 of the product. Other forms of the invention may be adapted to cooperate with simple rectangular products or products without any extensions such as flange 44 which may be used to engage projections on the pivot component. Where projections corresponding to projections 16 are incorporated in these alternate forms of the invention, the projections must be located on the pivot component so as to make contact with some portion of the product as the product is inserted into the shipping container.

FIG. 5 shows a view similar to FIG. 4, but with product 41 lowered into the received position and pivot component 11 in the support position. Product 41 is snugly received in product opening 19 (not labeled in FIG. 5 but shown best in FIG. 1) in bottom component 12. Pivot component 11 is in the support position tilted inwardly with respect to the loading position, so that inner protective element 14 and each lateral support element 17 engages product 41 (not labeled in FIG. 4 or 5). In the illustrated example, inner protective element 14 engages and protects a relatively fragile or weak housing component 42 of product 41 while lateral support elements 17 engage a structural frame of the product associated with flange 44. This arrangement provides maximum support for product 41 at the structural frame while protecting the more fragile outer surfaces of the product.

FIG. 5 also shows optional top component 51 installed over product 41 in the received position. Top component 51 is adapted to capture a top end of pivot component 11, thereby helping to retain pivot component 11 in the support position. Preferably, top component 51 is made of a resilient protective material so as to provide additional protection for product 41.

Figure 6:
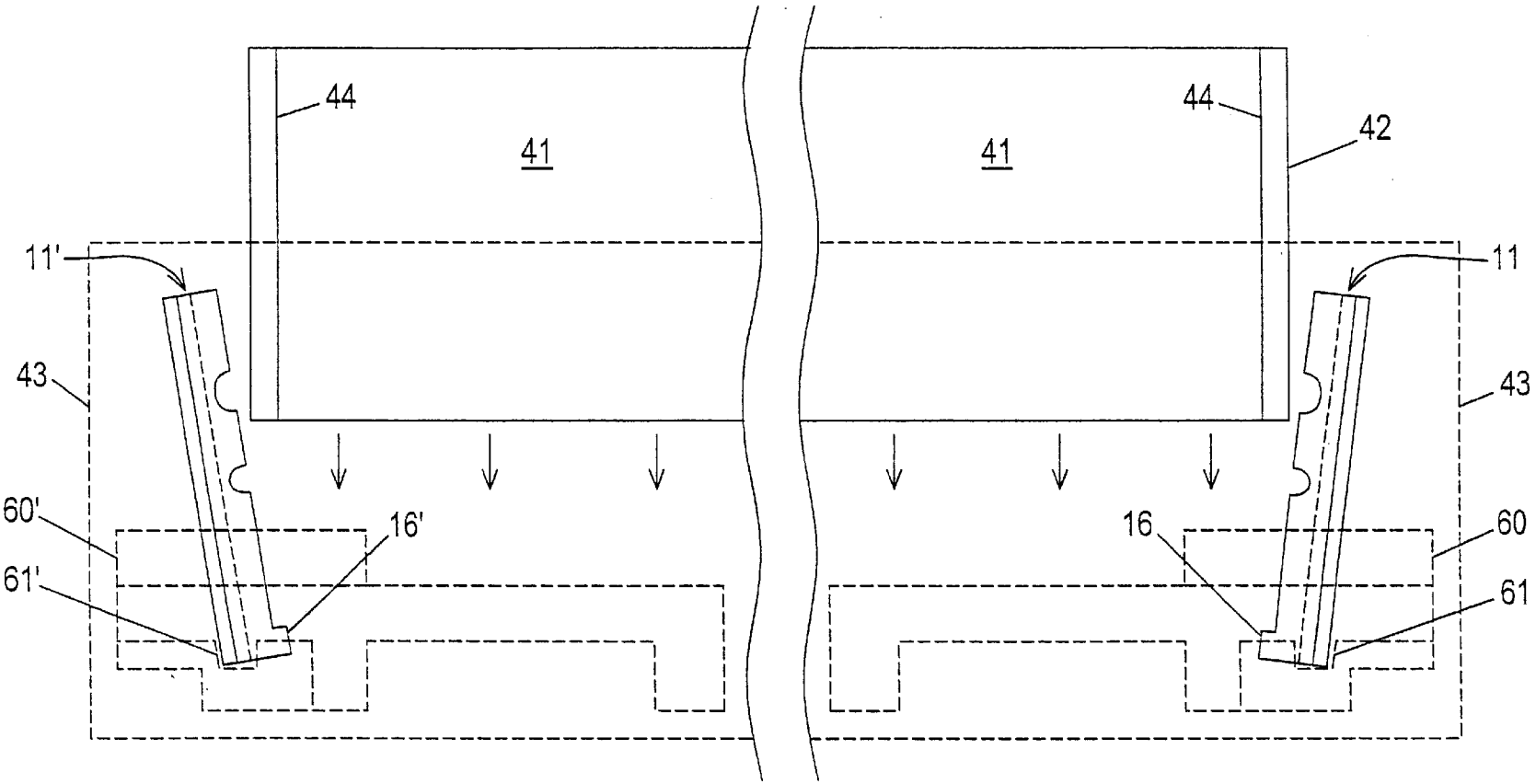
FIG. 6 shows a side view of the packaging system inside a shipping container, similar to FIG. 4, but with two pivot components at opposing ends of the product.

FIG. 6 is similar to FIG. 4, but shows a packaging system with two pivot components. The bottom component in this form of the invention is made up of two end sections 60 and 60'. Each of these sections are similar to the end of bottom component 12 shown in FIGS. 1, 4, and 5. These end sections are positioned in the bottom of container 43 at opposing ends of the container. Pivot component 11 is positioned in the loading position, supported in a pivot receptacle 61 of end section 60. Similarly, pivot component 11' is positioned in the loading position, supported in pivot receptacle 61' of end section 60'. Pivot receptacles 61 and 61' are similar to pivot receptacle 18 shown in FIGS. 1 and 3. Container 43 has dimensions sufficiently large to allow both pivot components 11 and 11' to tilt outwardly to their respective loading positions.

Figure 7:
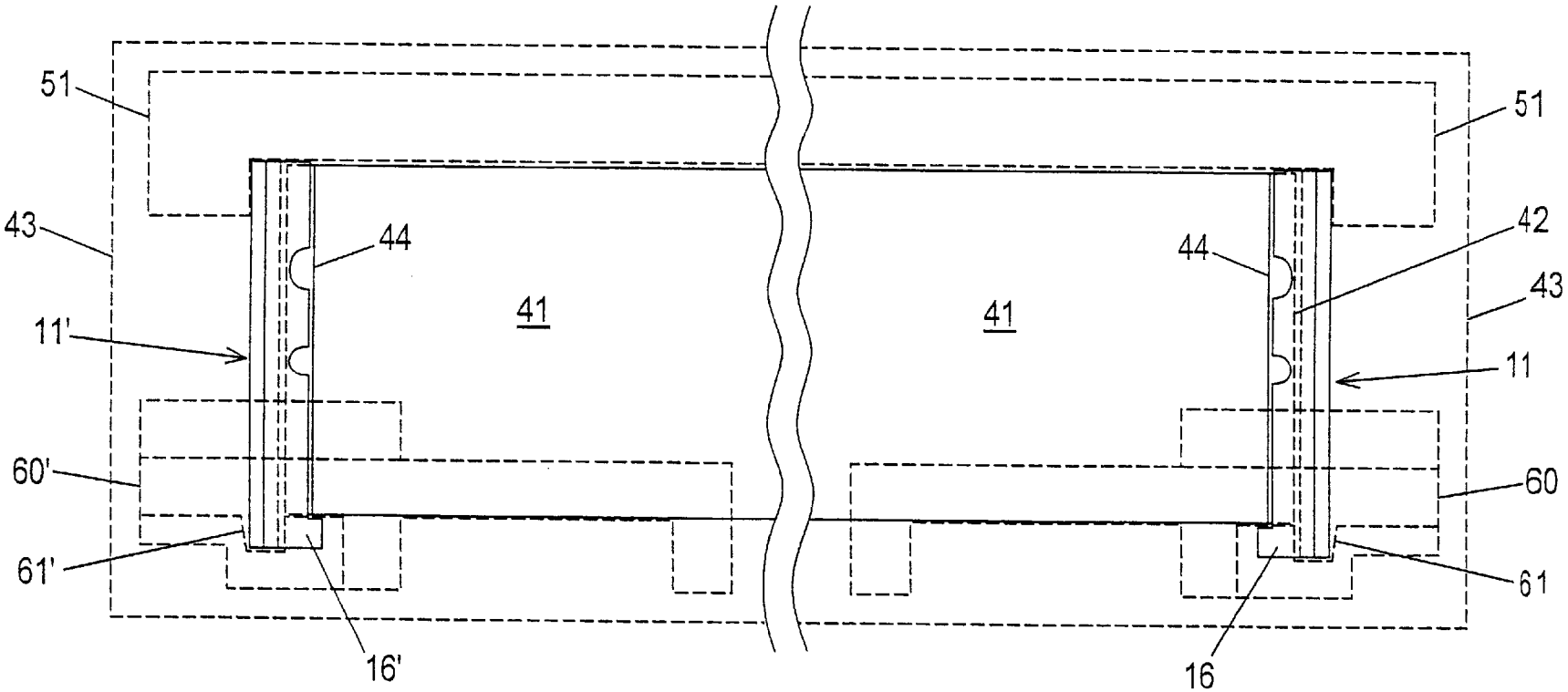
FIG. 7 shows a side view of the packaging system similar to FIG. 6, but with the product in the received position.

As product 41 is moved into the received position, flanges 44 on the product contact the respective projections 16 and 16' on each respective pivot component 11 and 11'. Each pivot component 11 and 11' automatically moves into the support position in response to the force applied to its respective projections by product 41. FIG. 7 shows a view similar to FIG. 6, but with product 41 in the received position and pivot components 11 and 11' each in their respective support position.

One skilled in the art can appreciate numerous variations of the preferred embodiment within the scope of the following claims. The following examples illustrate some of the possible variations. First, although shown in the Figures, inner protective element 14 need not engage the entire product housing component 42. One skilled in the art will know that it is desirable to have inner protective element 14 engage product housing component 42 as much as possible, as this will enhance the protecting aspect of the invention. Alternative forms of the invention may support the product only along its lateral edges and leave more fragile decorative features, such as certain housing components, isolated from any contact with packaging material. Second, lateral support elements 17 are not required by the invention if a specific product does not require concentrated support in lateral frame areas. In this case, inner protective element 14 can encompass the entire inner side of pivot component 11.

Figure 8:
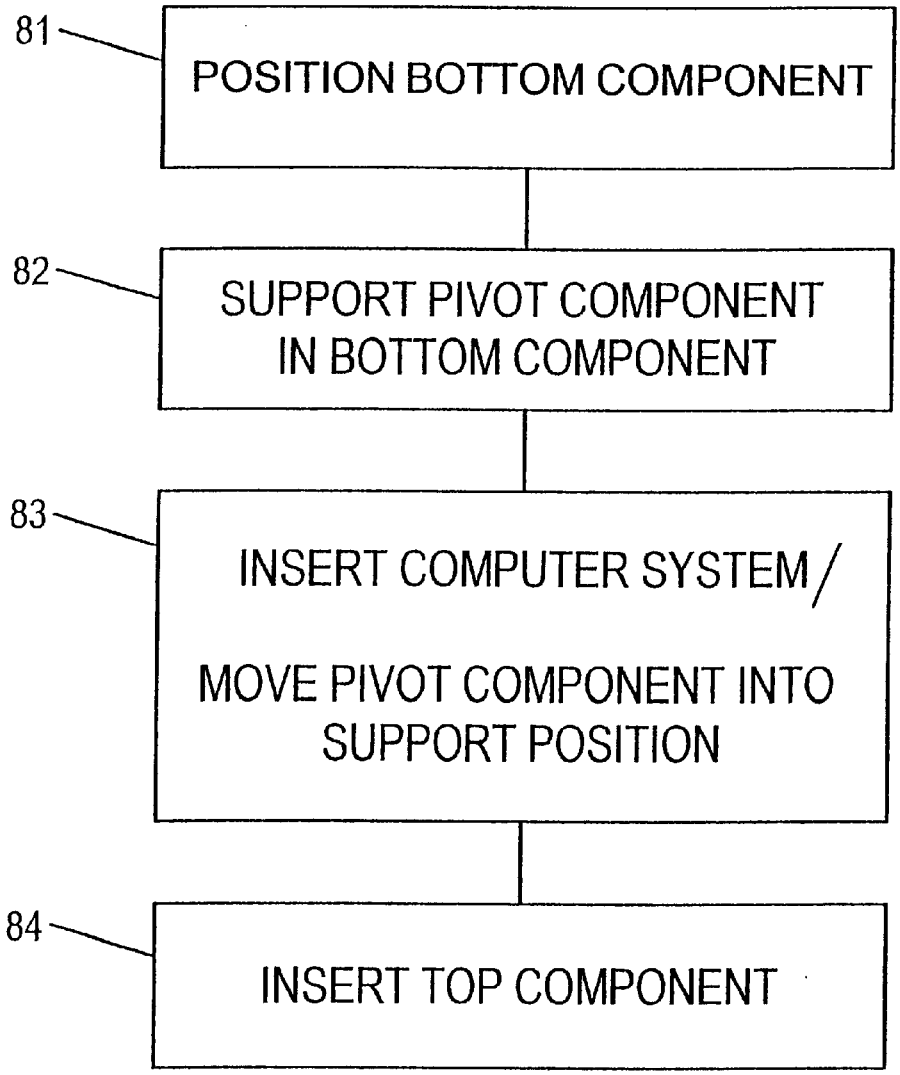
FIG. 8 is a flow chart showing the method steps according to the present invention.

The method for loading a computer system into a shipping container may be described with particular reference to FIG. 8. First, bottom component 12 is positioned at the bottom of shipping container 43 as shown at step 81. Step 82 includes supporting pivot component 11 in pivot receptacle 18 formed in bottom component 12 and positioning the pivot component in the loading position. The method next includes inserting computer system 41 into shipping container 43 to a received position resting on bottom component 12, as shown at step 83. As computer system 41 is inserted, it contacts a lower portion of pivot component 11. This contact automatically moves pivot component 11 from the loading position shown in FIGS. 4 and 6, to the support position shown in FIGS. 5 and 7. Finally, the preferred loading method includes step 84, inserting top component 51 over computer system 41 and pivot component 11, as shown in FIG. 5. Top component 51 captures or fits over the top edge of pivot component 11 to help retain the pivot component in the support position.

The above described preferred embodiments are intended to illustrate the principles of the invention, but not to limit the scope of the invention. Various other embodiments and modifications to these preferred embodiments may be made by those skilled in the art without departing from the scope of the following claims.

What is claimed is:

1. A protective packaging system comprising:

(a) a first pivot component including a base end, a rigid support structure, and a projection extending from an inner side of the first pivot component at the base end of the pivot component;

(b) a bottom component extending in a bottom component plane, the bottom component having a product opening adapted to receive a product in a received position, and further having a first pivot receptacle adapted to receive the base end of the first pivot component so that the first pivot component can move between a loading position and a support position, the first pivot component in the loading position being tilted outwardly wit respect to the bottom component and in the support position being tilted inwardly with respect to the loading position, the product opening and first pivot receptacle both facing from a first side of the bottom component in a direction transverse to the bottom component plane;

(c) an inner protective clement made of a resilient protective material covering a center portion of an inner side of the rigid support structure;

(d) two lateral support elements, each respective lateral support element being attached to the rigid support structure along a respective lateral side of the inner protective element, each lateral support element projecting farther from the rigid support structure than the inner protective element; and (e) wherein the projection on the first pivot component is in position to move the first pivot component from the loading position to the support position in response to a force applied to the projection in a direction substantially perpendicular to the bottom component plane.

2. The packaging system of claim 1 wherein the projection extends from a base end of at least one of the lateral support elements.

3. The packaging system of claim 1 further including a second pivot component supported in a second pivot receptacle in the bottom component, the second pivot receptacle adapted to receive a base end of the second pivot component so that the second pivot component can move between a loading position and a support position, the second pivot component in the loading position being tilted outwardly with respect to the bottom component and in the support position being tilted inwardly with respect to the loading position, the second pivot receptacle being located at an opposite end of the bottom component from the first pivot receptacle and facing from the first side of the bottom component.

4. The packaging system of claim 1 further comprising:

(a) a top component adapted to be placed over a product in the received position on the bottom component and capture a top end of the pivot component in the support position.

5. A computer shipping system comprising:

(a) a shipping container;

(b) a bottom component positioned at a bottom of the container, the bottom component extending in a bottom component plane and having a first pivot receptacle and a product opening formed therein and facing toward a top of the container;

(c) a first pivot component having a base end supported in the pivot receptacle, the pivot component being movable between a loading position in which the pivot component is tilted outwardly with respect to the bottom component, and a support position in which the pivot component is tilted inwardly with respect to the loading position;

(d) a projection extending from an inner side of the first pivot component at the base end thereof in position to move the first pivot component from the loading position to the support position in response to a force applied to the projection in a direction substantially perpendicular to the bottom component plane; and (e) a rigid support structure included wit the first pivot component, the rigid support structure including an inner protective element covering a center portion of an inner side of the rigid support structure and further including two lateral support elements, each respective lateral support element being attached to the rigid support structure along a respective lateral side of the inner protective element, and each lateral support element projecting farther from the rigid support structure than the inner protective element.

6. The shipping system of claim 5 wherein the projection extends from a base end of one lateral support element and a second projection extends from a base end of the other lateral support element.

7. The shipping system of claim 5 including a second pivot component supported in a second pivot receptacle in the bottom component, the second pivot receptacle being located at an opposing end of the bottom component from the first pivot receptacle.

8. The shipping system of claim 5 further comprising a top component adapted to be placed over a product in a received position on the bottom component and capture a top end of the pivot component in the support position to help retain the pivot component in the support position.

9. A method of loading a computer system into a shipping container, the method comprising the steps of:

(a) positioning a bottom component at a bottom of the shipping container;

(b) supporting a pivot component on the bottom component in a loading position in which the pivot component is tilted outwardly with respect to the bottom component;

(c) moving the computer system into a received position on the bottom component; and (d) as the computer system is being moved into the received position, contacting an inner side of the pivot component at a base end thereof to move the pivot component from the loading position to a support position in which the pivot component is tilted inwardly with respect to the loading position and engages the computer system.

10. The method of claim 9 wherein the pivot component includes a rigid support structure having an inner side that is covered with a resilient protective material, forming an inner protective element, and further including the step of engaging a decorative cover of the computer system with the inner protective element.

11. The method of claim 10 wherein the inner protective element covers a center portion of the inner side of the rigid support structure and lateral support elements are attached to the rigid support structure at each lateral side of the inner protective element, each lateral support element projecting farther from the rigid support structure than the inner protective element, and further including the step of supporting the computer system in the received position with the lateral support elements.

12. The method of claim 11 wherein a projection extends from a base end of one lateral support element and a second projection extends from a base end of the other lateral support element, and wherein contact between the computer system and the projection and second projection moves the pivot component to the support position.

13. The method of claim 9 further including the steps of:

(a) supporting a second pivot component on the bottom component in a position tilted outwardly with respect to the bottom component at an opposite end of the bottom component from the first pivot component; and (b) as the computer system is moved into the received position, contacting an inner side of the second pivot component at a base end thereof to move the pivot component from its outwardly tilted position to a position in which the pivot component is tilted inwardly to engage the computer system.

14. The method of claim 9 further including the step of placing a top component over the computer system, so as to capture a top edge of the pivot component and retain the pivot component in the support position.

* * * * *

UNITED STATES PATENT AND TRADEMARK OFFICE

CERTIFICATE OF CORRECTION

PATENT NO. : 6,695,140 B2
DATED : February 24, 2004
INVENTOR(S) : James Edwin Manuel It is certified that error appears in the above-identified patent and that said Letters Patent is hereby corrected as shown below:

Column 6,
Line 37, change “clement” to -- element --

Column 7,
Line 26, change “wit” to -- with --

Signed and Sealed this

Fifteenth Day of June, 2004

JON W. DUDAS
*Acting Director of the United States Patent and Trademark Office*